US011944209B1

(12) United States Patent
Byrne et al.

(10) Patent No.: US 11,944,209 B1
(45) Date of Patent: Apr. 2, 2024

(54) PORTABLE SLEEP SUPPORT STRUCTURES

(71) Applicant: Sleep Right LLC, Cottonwood Heights, UT (US)

(72) Inventors: Robert Byrne, Cottonwood Heights, UT (US); Ashleigh Byrne, Cottonwood Heights, UT (US)

(73) Assignee: Sleep Right LLC, Cottonwood Heights, UT (US)

( * ) Notice: Subject to any disclaimer, the term of this patent is extended or adjusted under 35 U.S.C. 154(b) by 0 days.

(21) Appl. No.: 18/531,547

(22) Filed: Dec. 6, 2023

(51) Int. Cl.

| | |
|---|---|
| ***A47C 20/00*** | (2006.01) |
| ***A47C 7/38*** | (2006.01) |
| ***A47C 16/00*** | (2006.01) |
| ***A47G 9/10*** | (2006.01) |

(52) U.S. Cl.
CPC ..... *A47C 7/383* (2013.01)

(58) Field of Classification Search
CPC ..... A47C 16/00; A47C 7/383; A47C 7/38
See application file for complete search history.

(56) References Cited

U.S. PATENT DOCUMENTS

| | | | | |
|---|---|---|---|---|
| 7,036,168 | B1 * | 5/2006 | Knickerbocker | A61G 13/12 5/636 |
| 7,044,267 | B2 * | 5/2006 | Sigler | B60N 2/80 182/15 |
| 7,364,129 | B1 * | 4/2008 | Levari, Jr. | A47G 23/0216 108/4 |
| 8,985,693 | B2 * | 3/2015 | Purpura | A45F 4/06 297/394 |
| 9,226,587 | B2 * | 1/2016 | Halimi | A47C 16/00 |
| 9,770,113 | B1 * | 9/2017 | Miller | A47C 16/00 |
| 9,877,588 | B2 * | 1/2018 | Belleh | A47C 7/38 |
| 10,226,130 | B2 * | 3/2019 | Hill | B60N 3/001 |
| 10,383,451 | B2 * | 8/2019 | Miller | A47C 7/383 |
| 10,646,045 | B2 * | 5/2020 | Hill | F16M 13/022 |
| 11,672,358 | B2 * | 6/2023 | Watanabe | B60N 2/2821 297/133 |
| 2002/0100846 | A1 * | 8/2002 | Tinsley | A61G 13/12 248/118 |
| 2008/0303318 | A1 * | 12/2008 | Hamilton | A47C 16/00 297/391 |
| 2011/0277238 | A1 * | 11/2011 | Mabry | A47C 16/00 5/112 |
| 2012/0181821 | A1 * | 7/2012 | Edalati | A47C 20/026 297/232 |

(Continued)

*Primary Examiner* — Shin H Kim
(74) *Attorney, Agent, or Firm* — Miller IP Law; Devin Miller

(57) ABSTRACT

A portable sleep support structure for enabling a user to rest comfortably while in a confined space or seated position. The sleep support structure is made of several elements that may be detachable from each other. The sleep support structure, which also includes telescoping elements, enables a user to rest and fall asleep by leaning forward into the sleep support structure which supports the head, neck and torso of a user. This support system enables a user to relax and makes sitting for long periods less stressful, because the user is able to sleep, rest or relax, in the seated position. The sleep support structure is anchored by the bodyweight of the user leaning into the structure, which is placed on the thighs of the user. A torso strap is also utilized to stabilize the chest of a user.

20 Claims, 14 Drawing Sheets

(56) References Cited

U.S. PATENT DOCUMENTS

| | | | | |
|---|---|---|---|---|
| 2013/0232696 | A1* | 9/2013 | Halimi | A47C 16/00 5/640 |
| 2014/0033439 | A1* | 2/2014 | Berhanu | A47C 16/00 5/640 |
| 2015/0001905 | A1* | 1/2015 | Jackow | B60N 2/806 297/397 |
| 2015/0282628 | A1* | 10/2015 | Hill | A47C 7/383 297/391 |
| 2016/0120326 | A1* | 5/2016 | Belleh | B60N 2/806 297/391 |
| 2017/0188715 | A1* | 7/2017 | Hill | B60N 2/882 |
| 2019/0159601 | A1* | 5/2019 | Hill | F16M 13/022 |
| 2021/0007477 | A1* | 1/2021 | Hill | F16M 11/041 |

* cited by examiner

PORTABLE SLEEP SUPPORT STRUCTURES

BACKGROUND

Humans are not equipped for sleeping in a seated position. Most people would find sleeping in a seated position uncomfortable as they are not able to support their body weight in a manner that would allow their body to go to sleep. Various implements and devices exist to provide comfort to a person when they need to rest while in a seated position.

BRIEF DESCRIPTION OF THE DRAWINGS

The present description will be understood more fully when viewed in conjunction with the accompanying drawings of various examples of the sleep support structure. The description is not meant to limit the sleep support structure to the specific examples. Rather, the specific examples depicted and described are provided for explanation and understanding of the sleep support structure. Throughout the description the drawings may be referred to as drawings, figures, and/or FIGs.

DETAILED DESCRIPTION

Figure 1:
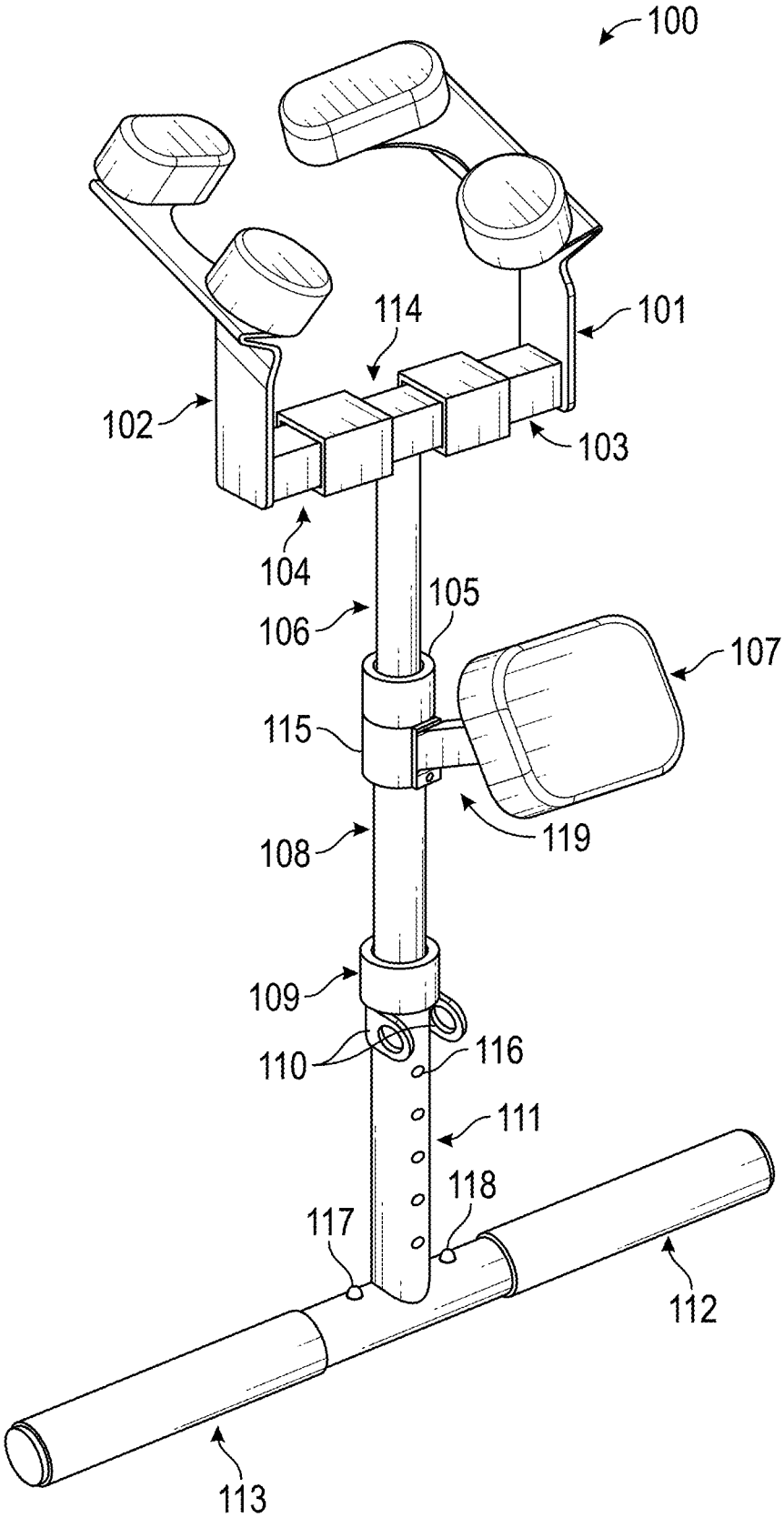
FIG. 1 illustrates a perspective view of the portable sleep support structure, according to an embodiment.

Portable sleep support structures as disclosed herein will become better understood through a review of the following detailed description in conjunction with the figures. The detailed description and figures provide merely examples of the various embodiments of portable sleep support structures. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein Conventional sleep structures do not provide adequate support for the modem traveler. Currently, when a person is traveling on a car, airplane, ferry, train, bus or the like, the seats only provide recumbent support for the head and neck. This type of support is not sufficient for a person that becomes sleepy and desires to rest comfortably. However, the limited and confined seating area that is typically provided is not conducive to restful sleep. A person sitting upright generally finds it difficult to fall asleep because their head cannot be positioned in a manner that allows them to be comfortable. Many travelers are forced to lean their head to one side or the other, or to allow their heads to bob up and down as they drift off to sleep—all uncomfortable options. This problem is exacerbated, when the person must remain seated for extended periods of time. As a result, many travelers are exhausted and weary after traveling because their travel was not restful.

Many devices have been brought to market to attempt to solve this problem. Inflatable pillows and specially formed neck pillows have become ubiquitous with the traveling public, desiring restful sleep on their journey. However, these devices require the person's head and neck to remain in a position that is generally upright and/or do not allow a person to position their head comfortably, so that they may drift off to sleep. The devices do not support the head and the body of a person and are not ideal for enabling a person's neck to completely relax.

Therefore, it is desirable to create a device that provides support for a person's head and neck so that they may sleep comfortably when seated and limited to a confined space, especially when they must sit for extended periods of time. Additionally, the device must be adjustable to suit the needs of the person that is utilizing the device.

Implementations of portable sleep structures may address some or all of the problems described above. A portable sleep structure may include a structure that comfortably supports the head, neck and torso of a traveler that is confined to a small seating area. The portable sleep structure is constructed in a manner that enables a traveler to lean forward without keeling over, and relax without having to subconsciously adjust their position to prevent from falling or bobbing their head.

The drawings included in this application depict the present application in many alternative embodiments. Elements that are displayed in multiple figures are identified by the same numeral, unless the view in the alternative figure illustrates a different angle that is germane to identifying and describing the various elements of the present application.

The present application relates to a portable sleep support structure which allows a seated person to rest their head and neck in a position that is desired for them. The sleep support structure supports the weight of the user by providing support for the user's head, neck and chest. The support structure may be adjustable, so that the height at which the head and chest are positioned may be altered so that the user may find the best, comfortable position.

FIG. 1 illustrates a perspective view of one embodiment of the sleep support structure 100, in accordance with one embodiment. The sleep support structure 100 details the structure for enabling a user to relax and sleep in a confined, seated position. The depicted embodiment of the portable sleep support structure 100 may include a T-shaped base member 111 (also referred to as "base member"), which may be configured to receive a vertically adjustable element, where the vertically adjustable element may comprise an upper leg 106 and a lower leg 108. The vertically adjustable element may be attached to the base member 111 via a ball-detent locking mechanism 116. In the embodiment of FIG. 1, 4 locking holes are displayed. These detent holes are to enable a user to adjust the height of the attachment for the vertically adjustable element. In another embodiment, the base member 111 may include less detent holes or multiple detent holes or a different, adjustable locking system, designed to firmly attach the vertically adjustable member to the base member 111 without departing from the scope of the present application. In another embodiment, the T-shape of base member 111 may be formed where the horizontal structure of base member 111 may be configured to receive the horizontal support elements 112 and 113, and the vertical structure of the base member 111 may be formed to receive the vertically adjustable element.

In another embodiment, upper leg 106 and lower leg 108 of the vertically adjustable member, may be detachable from the base member 111. In an embodiment, the vertically adjustable element may be an aluminum tubular, adjustable shaft or a telescoping leg or shaft that extends to one's desired length between the face down to the knees, equipped with a rotational locking mechanism, that may be used to lock the vertically adjustable element in place. One of ordinary skill in the art would note that the portable sleep support structure may also be generally referred to as an apparatus.

Figure 4:
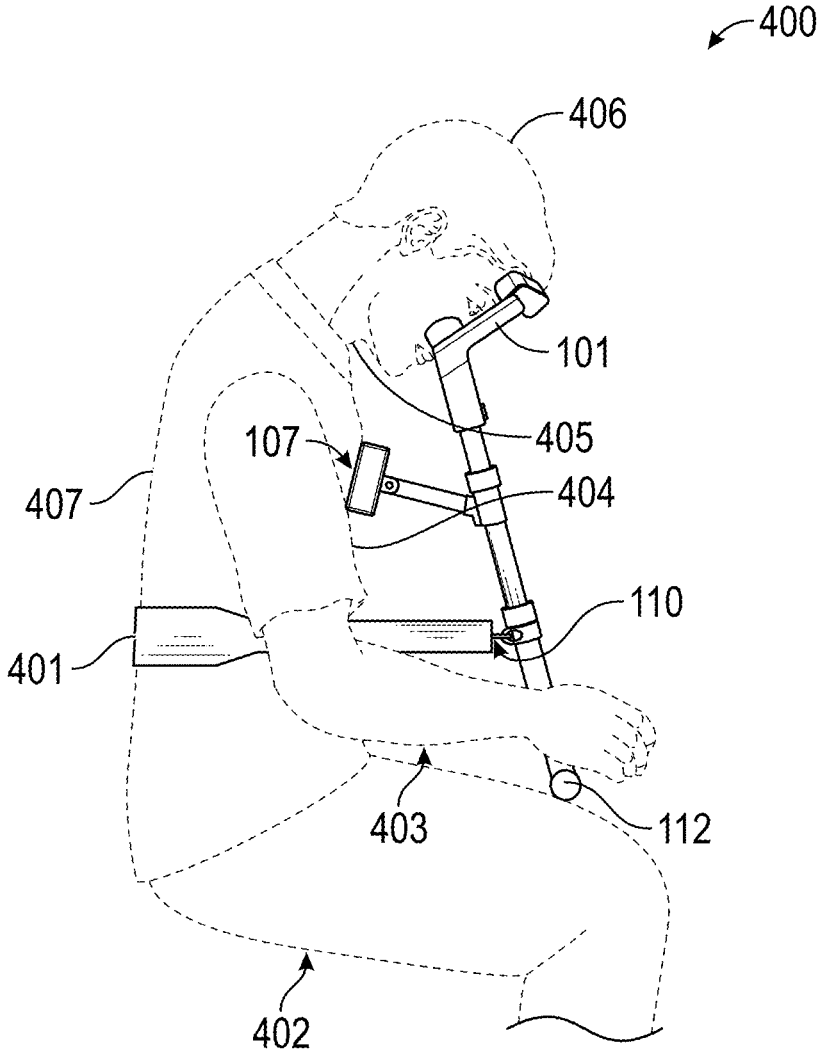
FIG. 4 illustrates a side view of a user utilizing the sleep support structure, according to an embodiment.

The base member 111 may include a pair of rings 110 which may be further configured to receive a torso support strap (see element 401 of FIG. 4). In an embodiment, the pair of rings 110 may be eyeholes. The base member 111 may be further configured to receive horizontal support elements 112 and 113. The horizontal support elements 112 and 113 may be attached to the base member by ball-detent locking mechanism 118 and 117 respectively. In another embodiment, the detent locking mechanism may be replaced by a different locking mechanism, such as a rotational lock designed to hold the horizontal support elements 112 and 113 in place, without departing from the scope of the present application. In FIG. 1, horizontal elements 112 and 113 are illustrated as circular bars with black grips at the end, intended to support a user, when placed on a user's thighs. The grip on the horizontal elements 112 and 113 may be made from materials such as silicone, neoprene, foam or vinyl and other materials known to those in the art.

The upper leg 106 of the vertically adjustable element, may include a proximal end and a distal end, and the distal end may be attached to an upper horizontal bar 114. In another embodiment, the upper horizontal bar 114 may be detachable from the upper leg 106.

The lower leg 108 may include a proximal end and a distal end and an inner diameter and an outer diameter where upper leg 106 has a diameter that is less than the inner diameter of the lower leg 108 such that the lower leg 108 may receive the upper leg 106. Lower leg 108 may further include a channel or hollow chamber molded into the lower leg 108 to receive the extensions of upper leg 106. The distal end of the lower leg 108 may include a locking mechanism 105 that may enable the upper leg 106 to be locked into position where the upper leg 106 may be rotated about a central axis of the lower leg 108 to engage and disengage the locking mechanism 105. The base member 111 may also include a locking mechanism 109 that may enable the lower leg 108 to be locked into position where the lower leg 108 may be rotated about a central axis of the base member 111 to engage and disengage the locking mechanism 109. In another embodiment, the locking mechanism such as locking mechanism 109 may be also referred to as a rotational lock or rotational locking mechanism, which may be locked and unlocked, by rotating lower leg 108 in a clockwise and an anticlockwise direction respectively.

The portable sleep support structure 100 may also include a first face support element 101 that may be attached to the upper horizontal bar 114, where the first face support element 101 may be attached to the upper horizontal bar 114 via a first telescoping arm 103.

The portable sleep support structure 100 may also include a second face support element 102 that may be attached to the upper horizontal bar 114, where the second face support element 102 may be attached to the upper horizontal bar 114 via a second telescoping arm 104.

In one embodiment, the face support elements 101 and 102 each include two face plates, contoured with foam pads on each element to support the face and, in turn, the neck. In an embodiment, each face plate may be equipped with a first face pad and a second face pad. The first face pad may be configured to fit a user's forehead and orbital bones and the second face pad may be configured to fit a user's cheekbones and may be placed on aluminum plates, which may be angled on the side of the face so visibility for reading, working, gaming is not obscured. In another embodiment, the foam pads may be replaced with alternate materials known in the art to provide a comfortable fit to a user's face.

In an embodiment, face support element 101 may include first face pad 120 and second face pad 121. Face pad 120 may be optimally configured to fit against a user's face and more particularly may be positioned and shaped to fit against a user's cheekbones. Face pad 121 may be optimally configured to fit against a user's face and more particularly may be positioned and shaped to fit against a user's orbital bones. Similarly, face support element 102 may include first face pad 122 and second face pad 123. Face pad 122 may be optimally configured to fit against a user's face and more particularly may be positioned and shaped to fit against a user's cheekbones. Face pad 123 may be optimally configured to fit against a user's face and more particularly may be positioned and shaped to fit against a user's orbital bones. In another embodiment, face pads 121 and 123 respectively and face pads 120 and 122 respectively are shaped differently because they have been designed with different functions in mind where face pads 121 and 123 support the orbital bones and face pads 120 and 122 support the cheekbones. Additionally, there is a space between face pads 121 and 120 which may allow a user to rest their face against the face pads without having their vision obscured. Similarly, there is a space between face pads 122 and 123, which may allow a user to rest their face against the face pads without having their vision obscured. Moreover, there is also a space between face support elements 101 and 102 to further enable a user to rest their face without obscuring their vision.

The portable sleep support structure 100 may also include a detachable torso support pad 107 attached to lower leg 108 of the vertically adjustable element via clamp 115. The portable sleep structure 100 may also include a strap attached to the pair of rings 110 on the base member 111. The strap may be configured to secure the torso of a user, when the user leans forward and places their chest on the torso support pad 107.

In one embodiment, the portable sleep support structure 100 may be further configured, so that the upper leg 106 is unable to rotate, and further unable to be engaged telescopically when the locking mechanism 105 is engaged.

In another embodiment, the portable sleep support structure 100 may include a locking mechanism 105, which may be engaged when a user rotates the upper leg 106 in one direction, such as a clockwise position, and the locking mechanism 105 may be disengaged when the user rotates the upper leg 106 in an opposite direction, such as a counter-clockwise position.

The portable sleep support structure 100, may also include first and second face support elements 101 and 102 respectively, which may include ergonomically designed pads to contour to the face of a user, that may comfortably support the head of the user, when the face is placed onto the first and second face support elements 101 and 102 respectively. The pads on elements 101 and 102 respectively may have various thicknesses or shapes as required to create a best fit for a user. The The portable sleep support structure 100 may further include ergonomically designed pads that may be detachable from the first and second face support elements 101 and 102 respectively.

The portable sleep support structure 100, where the first face support element 101 may be attached to the upper horizontal bar 114 via a first telescoping arm 103, and the second face support element 102, may be attached to the upper horizontal bar 114 via a second telescoping arm 104, where the first and second telescoping arms 103 and 104 respectively, are configured to extend away from the vertically adjustable member in a direction perpendicular to the vertically adjustable member, where the direction enables the first and second face support elements 103 and 104 respectively to support the face of a user.

Figure 3:
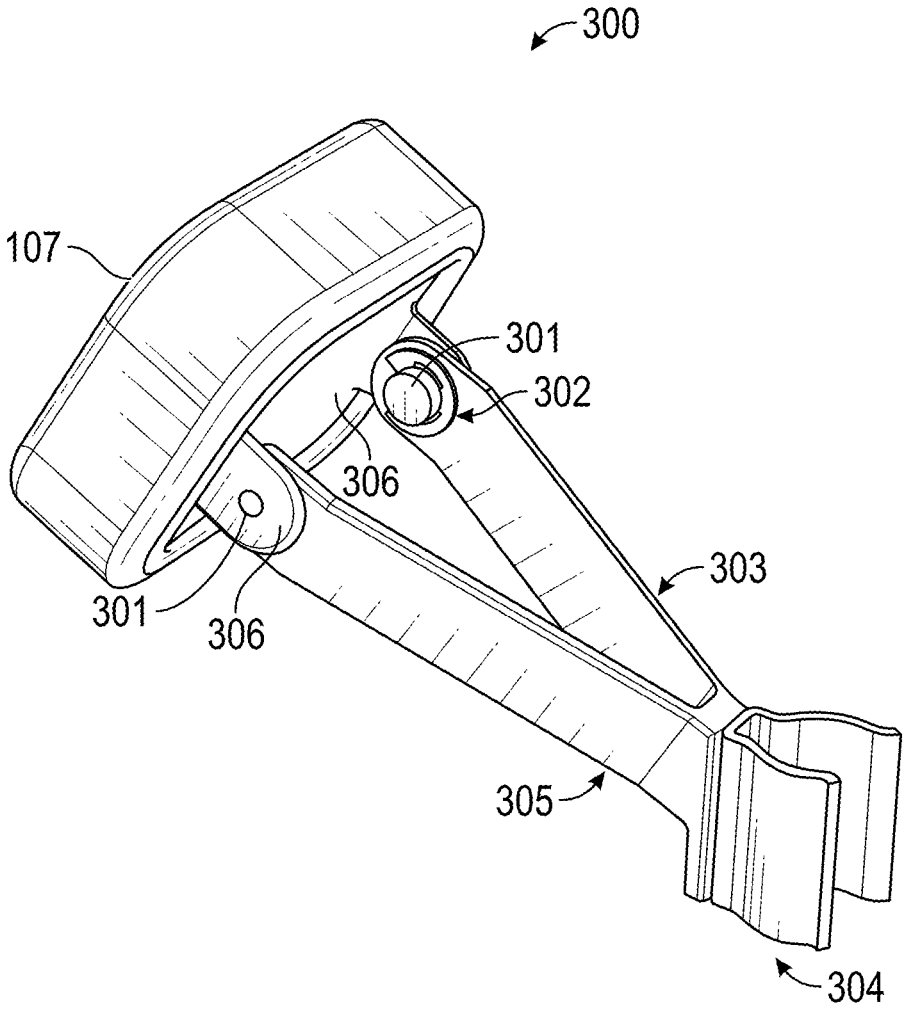
FIG. 3 illustrates the torso support system of the portable sleep support structure, according to an embodiment.

The portable sleep support structure 100 may further include a torso support pad 107 which may be attached to the vertically adjustable element by a V-shaped arm 119 (as shown in FIG. 3—see elements 303 and 305), where the V-shaped arm 119 may be configured to extend away from the vertically adjustable element in an angled direction, to best support the chest of a user. In a separate embodiment, the V-shaped arm 119 may further comprise telescoping elements such as, a first telescoping arm and a second telescoping arm, so that the length of the V-shaped arm 119 may be adjusted to best support the chest of a user.

Figure 2:
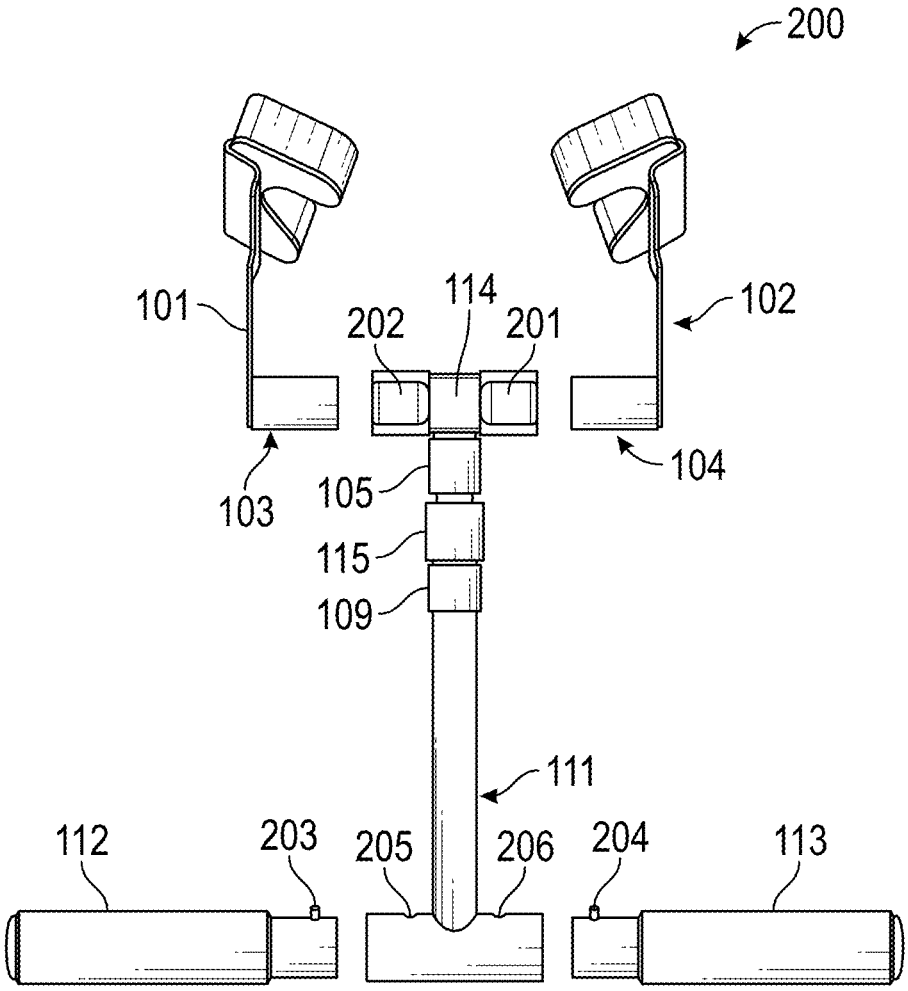
FIG. 2 illustrates a front view of the portable sleep support structure, according to an embodiment.

FIG. 2 depicts a front view of one the sleep support structure 200, in one embodiment. The sleep support structure 200 may provide an alternative view of the sleep support structure that illustrates detachable elements.

FIG. 2 includes elements 201 and 202 which are clips that may be used to adjust the length of telescoping arms 103 and 104 respectively. FIG. 2 further illustrates the ball-detent mechanism (shown in FIG. 1 as elements 117 and 118), where the mechanism 117 of FIG. 1 is deconstructed into the ball 203 and the hole 205. Similarly, the mechanism 118 of FIG. 1 is deconstructed into the ball 204 and the hole 206.

In FIG. 2, the length of the horizontal support elements 113 and 114 may be 7.5 inches. The length of the base member 111—(with the upper leg 106 and lower leg 108 of the vertically adjustable element fully retracted)—may be 10 inches. In another embodiment, the lengths of these elements may be changed or adjusted to enable the sleep support structure to fit a larger or smaller person without departing from the scope and nature of the present application.

The portable sleep structure 200 of FIG. 2 also illustrates how the portable sleep structure may be disassembled. The horizontal support elements 112 and 113 respectively may be detached from the T-shaped base member 111. Additionally, face support elements 101 and 102 may be detached from the upper horizontal bar 114. In an embodiment, the horizontal support elements 112 and 113 may be detached by pressing down on the ball 203 and 204 respectively to disengage a locking mechanism. The portable sleep structure may be carefully separated into sections by detaching the elements for convenient storage or transportation.

In FIG. 3, the torso support system 300 is depicted. The torso support system 300 may provide a view of the individual elements of the torso support system. The torso support system 300 may include frame 306. The torso support system 300 may also include a clamp 304 and a V-shaped arm which may include elements 303 and 305, which may be attached to frame 306 via bolt 301 and washer 302. In an embodiment, the V-shaped arm may be shaped like the letter "V" and may be typically made of a strong metal. The two ends of the V-arm (303 and 305) may be fastened to the frame 306 being connected via clamp 304 to lower leg 108, forming a triangle shape that distributes weight and stress evenly. The frame 306 may also include a torso support pad 107. The attachment of the frame 306 to the V-shaped arms 303 and 305 respectively, may enable the torso pad 107 to rotate freely about the axis of the bolts, so that the chest of a user of the sleep support structure 100 may be adequately supported when the user rests against the sleep support structure 100. The clamp 304 may be used to detachably connect the torso support system 300 to the vertically adjustable element—(the clamp is illustrated as element 115 of FIG. 1). In another embodiment, the clamp may not be the only locking mechanism that may be used to attach the torso support system 300 to the vertically adjustable element without departing from the scope of the present application. Additionally, the torso support pad 107 may be of a different shape or thickness to provide the most ergonomic fit for a user. In another embodiment, the torso support pad may be detachable and ergonomically designed to fit against the chest of a user. The ability to detach and switch torso pads would enable a user to select a torso support pad that provides the best support.

FIG. 4 depicts a side view of a user utilizing the sleep support structure 400, in accordance with an embodiment. The sleep support structure 400 may illustrate a seated user, utilizing the sleep support structure. FIG. 4 includes torso support strap 401 which may be attached to rings 110. The torso support strap may work in conjunction with the torso support system 300—wrapping around the user's back 407 to support and stabilize the weight of a user that leans into the sleep support structure. In the embodiment illustrated, the user who may be seated, rests or positions horizontal support element 112 on their thigh 402 (the other thigh and horizontal support element 113). The user's chest 404 may be placed against torso support pad 107, and the user's head 406 may be placed against face support element 101 (the other side of the face and face support element 102). When a user leans into the sleep support structure 400 as illustrated, the user's arm 403 may come to rest over the horizontal support element 112 after the sleep support structure is positioned, and the user's neck 405 is stabilized because the chest 404 and the head 406 are both supported. This support enables the user to relax and fall asleep while sitting.

Figure 5:
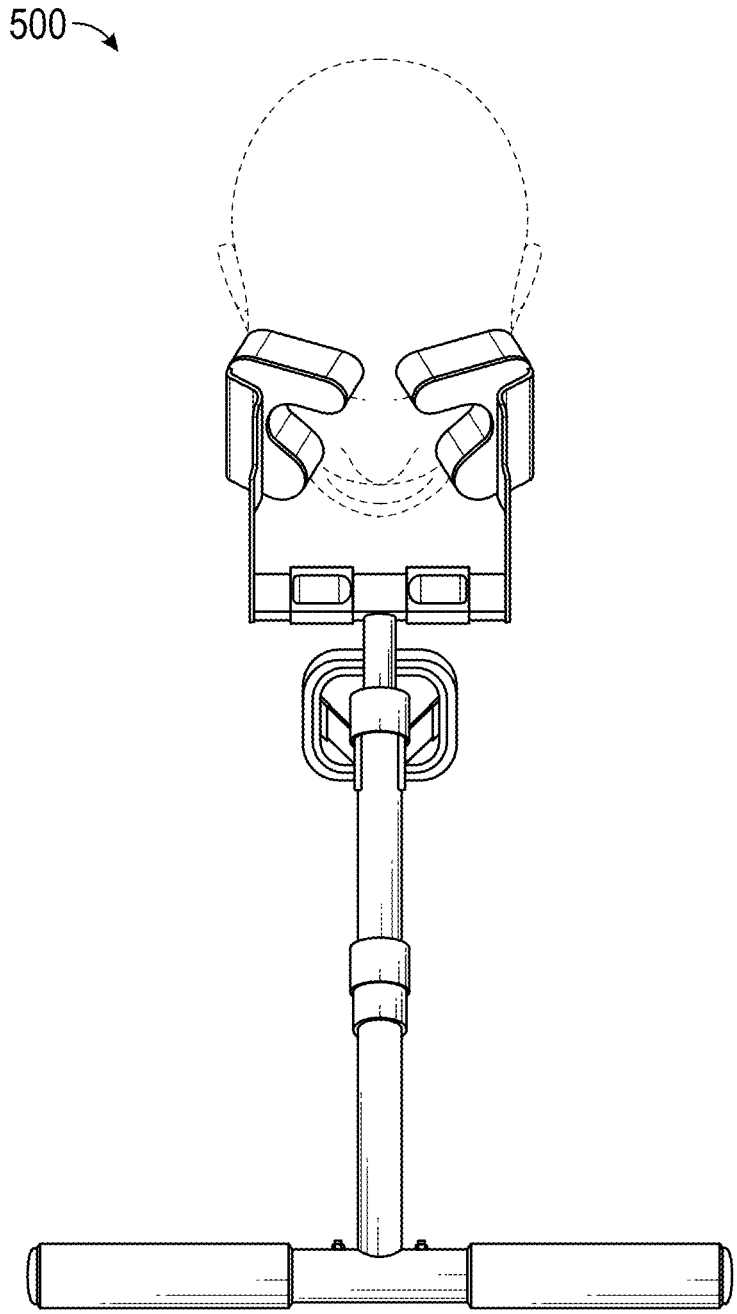
FIG. 5 illustrates a front view of a user's head utilizing the sleep support structure, according to an embodiment.

FIG. 5 depicts a front view of a user's head utilizing the sleep support structure 500, in accordance with an embodiment. The sleep support structure 500 may illustrate the head of a user as it is placed on the support. The length of the horizontal support elements 112 and 113 and the base member 111 may be 16 inches as illustrated in the figure. In another embodiment, the length of the horizontal support elements 112 and 113 and base member 111 may be varied, to adapt the structure to a smaller or larger space, without departing from the scope of the present application. FIG. 5 further illustrates an opening or space 501, where the user's face is resting on the face support elements 101 and 102 respectively and the eyes and nose of the user may be unobstructed. The layout of the elements of the portable sleep structure may be coordinated so that space 501 enables a user to rest without obstructing their vision or breathing by ensuring these vital organs (eyes and nose) are not impacted when the face and head may be resting against the face support elements.

Figure 6:
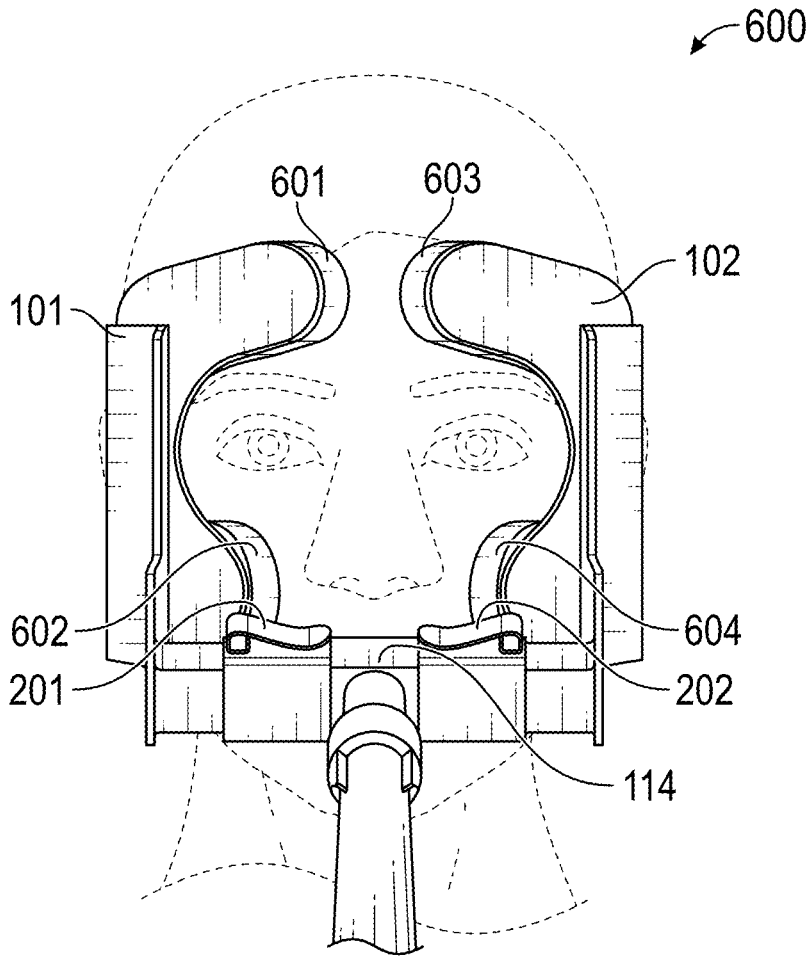
FIG. 6 illustrates a view of the sleep support structure, illustrating the face of a user utilizing the sleep support structure, according to an embodiment.

FIG. 6 depicts a view of the sleep support structure 600, illustrating the face of a user utilizing the sleep support structure, in accordance with an embodiment. The sleep support structure 600 may illustrate a closeup of a user's face, as it is placed on the sleep support structure. The closeup of the user's face further illustrates that the view of the user may not be obstructed, when their face may be supported by the sleep support structure 600. In sleep support structure 600, the face pad 121, and face pad 123, located on face support element 101 and face support element 102 respectively may be illustrated as supporting the face of a user. Similarly face pad 120 and face pad 122, located on face support element 101 and face support element 102 respectively, may be illustrated as supporting the face of a user. In another embodiment face support elements 101 and 102 may be configured to enable the elements (101 and 102) to swivel about the axis of the upper horizontal bar 114, to enable a user to place their head comfortably.

Face pad 121 and face pad 123 may support the head by pressing against the orbital bones of the face. Face pad 120 and face pad 122 may support the head by pressing against the cheekbones of the face. The orientation of the face pads 121-122, may ensure that the vision of a user may not be obscured by the sleep support structure 600. In another embodiment, face pads 120, 121, 122 and 123 may be detachable, to enable a user to utilize different face pads, such as face pads that provide more or less support due to their level of firmness, thickness or shape or overall configuration and ergonomic design without departing from the scope of the present application.

Figure 7:
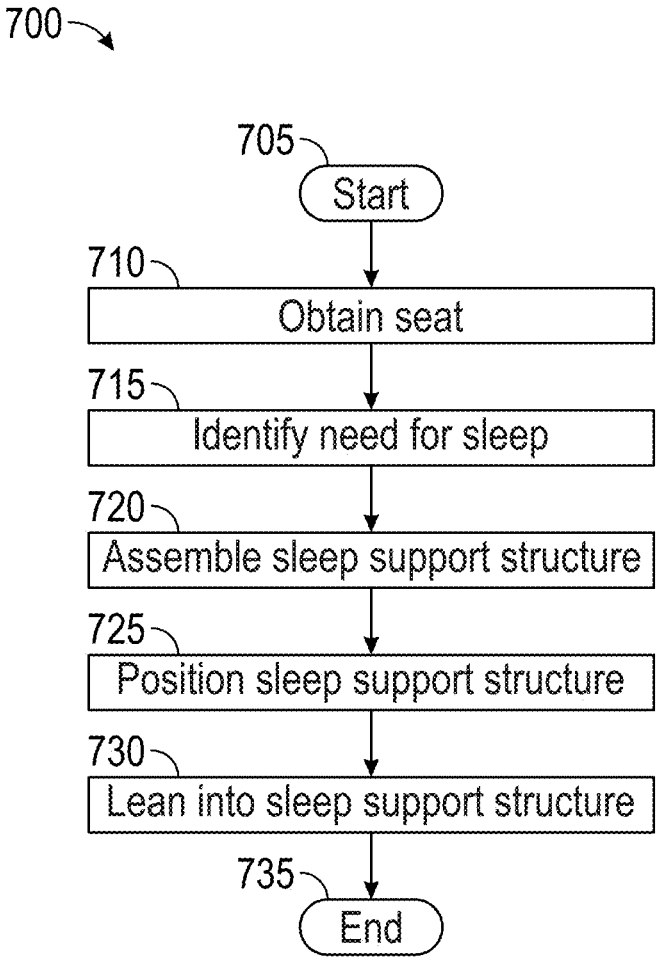
FIG. 7 illustrates a method for utilizing the sleep support structure, according to an embodiment.

FIG. 7 illustrates a method 700 for utilizing the sleep support structure, according to an embodiment. The method 700 may illustrate a simplified method for utilizing the sleep support structure in a confined space. The method 700 may start at 705, and continue to step 710 where a user obtains a seat. Once seated, the user may become tired or fatigued and identify their need for sleep at step 715. At step 720, the user may assemble the sleep support structure, and at step 725, the sleep support structure may be positioned or located on the thigh of the user. At step 730, the user may lean into the sleep support structure, where the body weight of the user is supported so that the user may rest, relax and fall asleep. Method 700 then ends at step 735.

Figure 8:
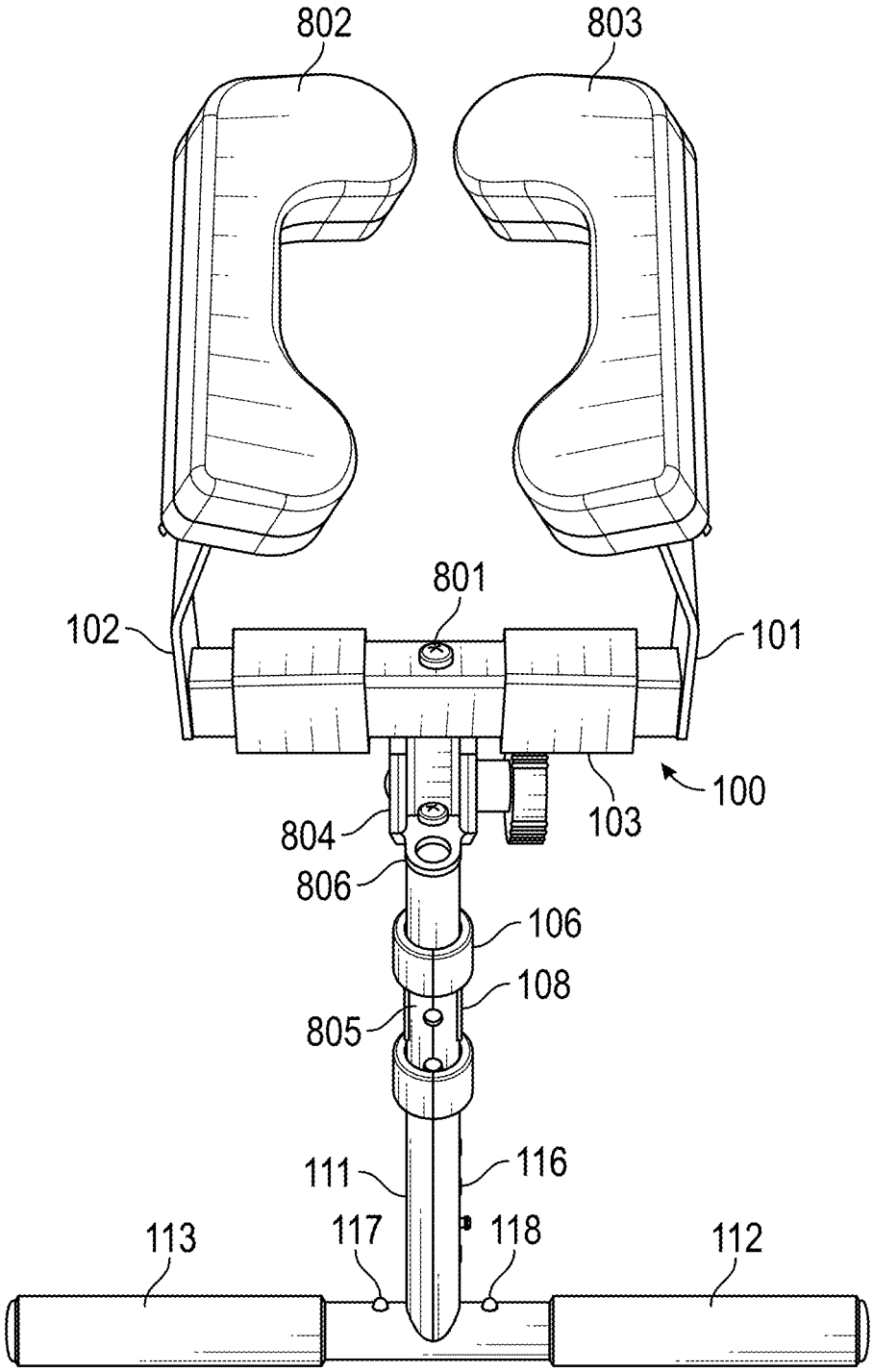
FIG. 8 illustrates a perspective view of the portable sleep support structure, according to an embodiment.

FIG. 8 illustrates an embodiment of the portable sleep support structure 100 incorporating the T-shaped base member 111, the upper leg 106 and the lower leg 108, the ball-detent locking mechanism 116, 117 and 118, the horizontal support elements 112 and 113, as well as a set screw element 801 to allow the user to increase or decrease the distance between the first and second face support elements 101 and 102 by up to two inches of displacement in either direction along the first telescoping arm 103, enabling a variety of facial sizes and shapes to fit into the first and second face support elements 101 and 102. The set screw 801 may be in communication with a knob that tightens to secure the position of the first and second face support elements 101 and 102. The first and second face support elements may further be modified to include a first and second full face support elements 802 and 803 for increased support and comfort for users.

Figure 9:
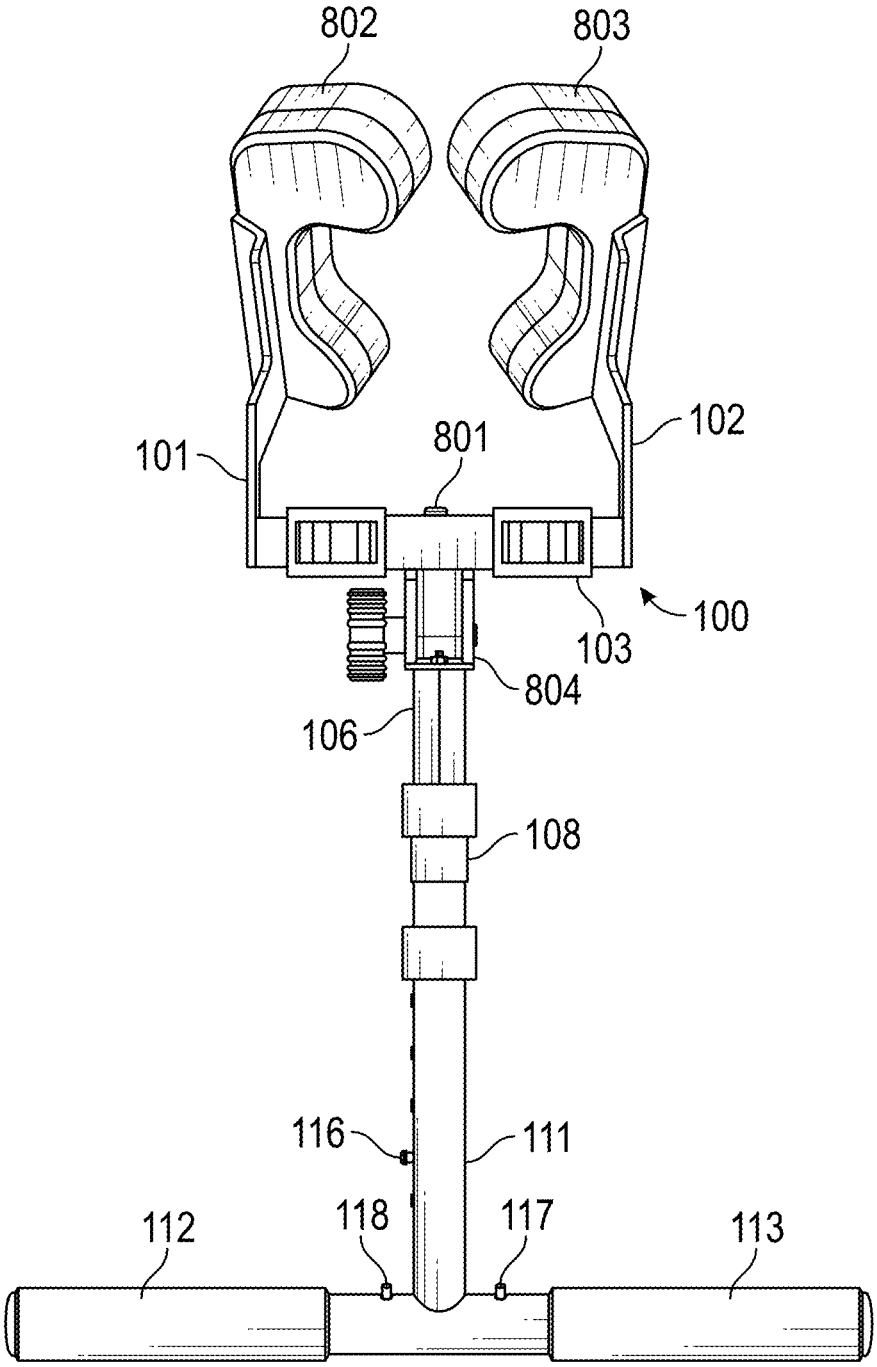
FIG. 9 illustrates a front view of the portable sleep support structure, according to an embodiment.

FIG. 9 illustrates an embodiment of the portable sleep support structure 100 incorporating the T-shaped base member 111, the upper leg 106 and the lower leg 108, the ball-detent locking mechanism 116, 117 and 118, the horizontal support elements 112 and 113, as well as a set screw element 801, The embodiment further illustrates a radial adjustment element 804 that enables users to adjust the position of the first telescoping arm 103 on a 360-degree radius.

Figure 10:
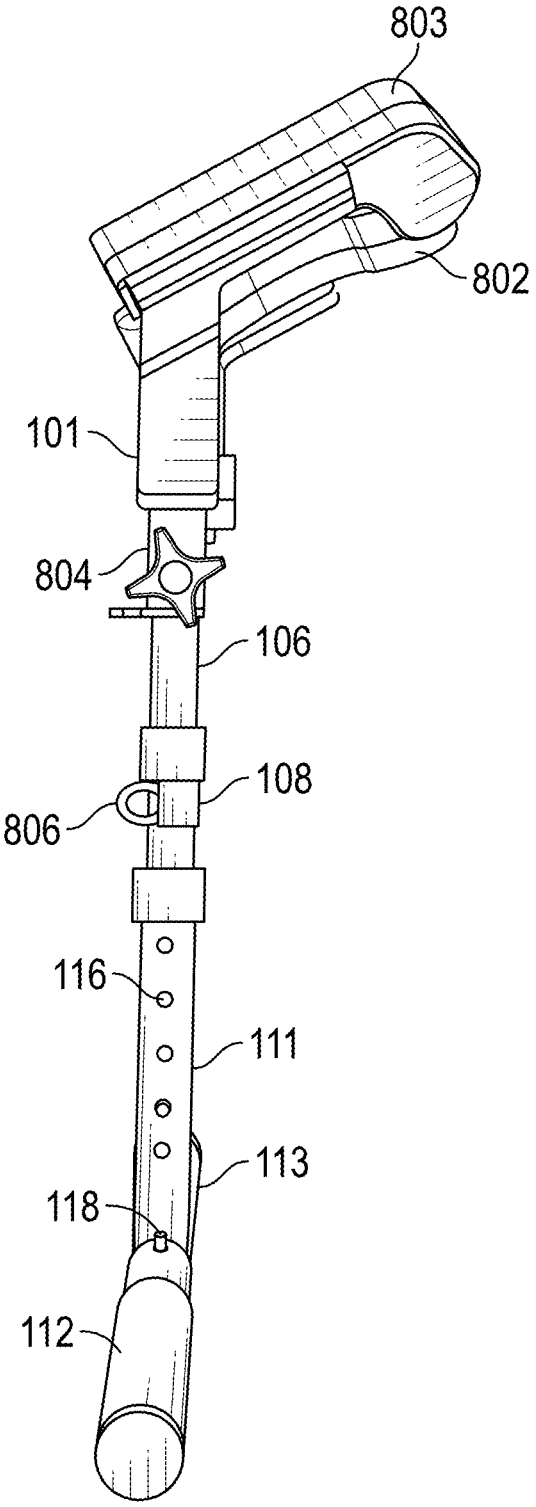
FIG. 10 illustrates aside view of the portable sleep support structure, according to an embodiment.

FIG. 10 illustrates an embodiment of the portable sleep support structure 100 incorporating the T-shaped base member 111, the upper leg 106 and the lower leg 108, the ball-detent locking mechanism 116, 117 and 118, the horizontal support elements 112 and 113, as well as a set screw element 801. The embodiment further illustrates a torso strap ring 806 which may be further configured to receive the torso support strap, whereby the location of the torso strap ring 806 is located below the radial adjustment element 804, allowing for increased pressure on a user's face where positioned into the first and second full face support elements 802 and 803. The strap may be configured to secure the torso of a user. In an embodiment, the torso strap ring 806 may be an eyehole.

Figure 11:
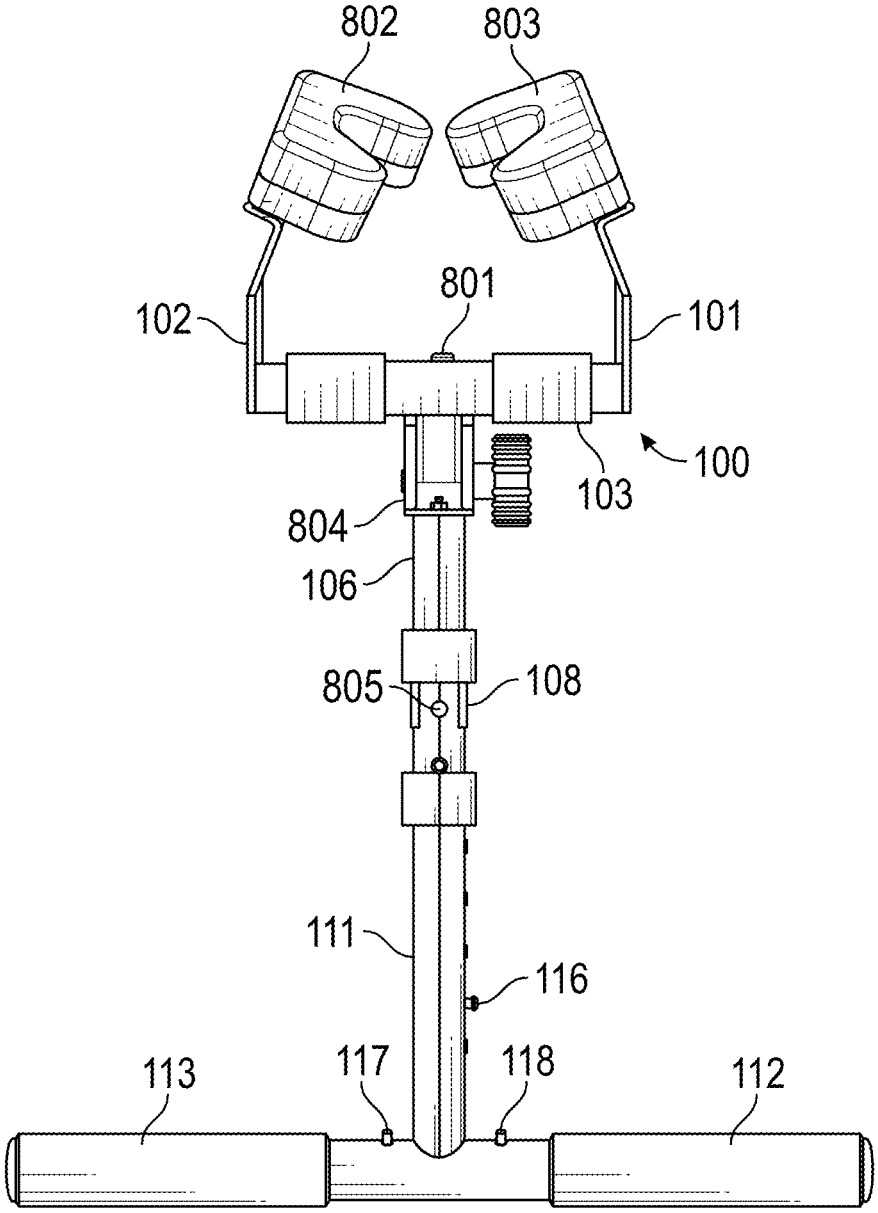
FIG. 11 illustrates a rear view of the portable sleep support structure, according to an embodiment.

FIG. 11 illustrates an embodiment of the portable sleep support structure 100 incorporating the T-shaped base member 111, the upper leg 106 and the lower leg 108, the ball-detent locking mechanism 116, 117 and 118, the horizontal support elements 112 and 113, as well as a set screw element 801. The embodiment further illustrates a ball-detent locking mechanism 805 situated into the lower leg 108 to increase the stability of the lower leg 108.

Figure 12:
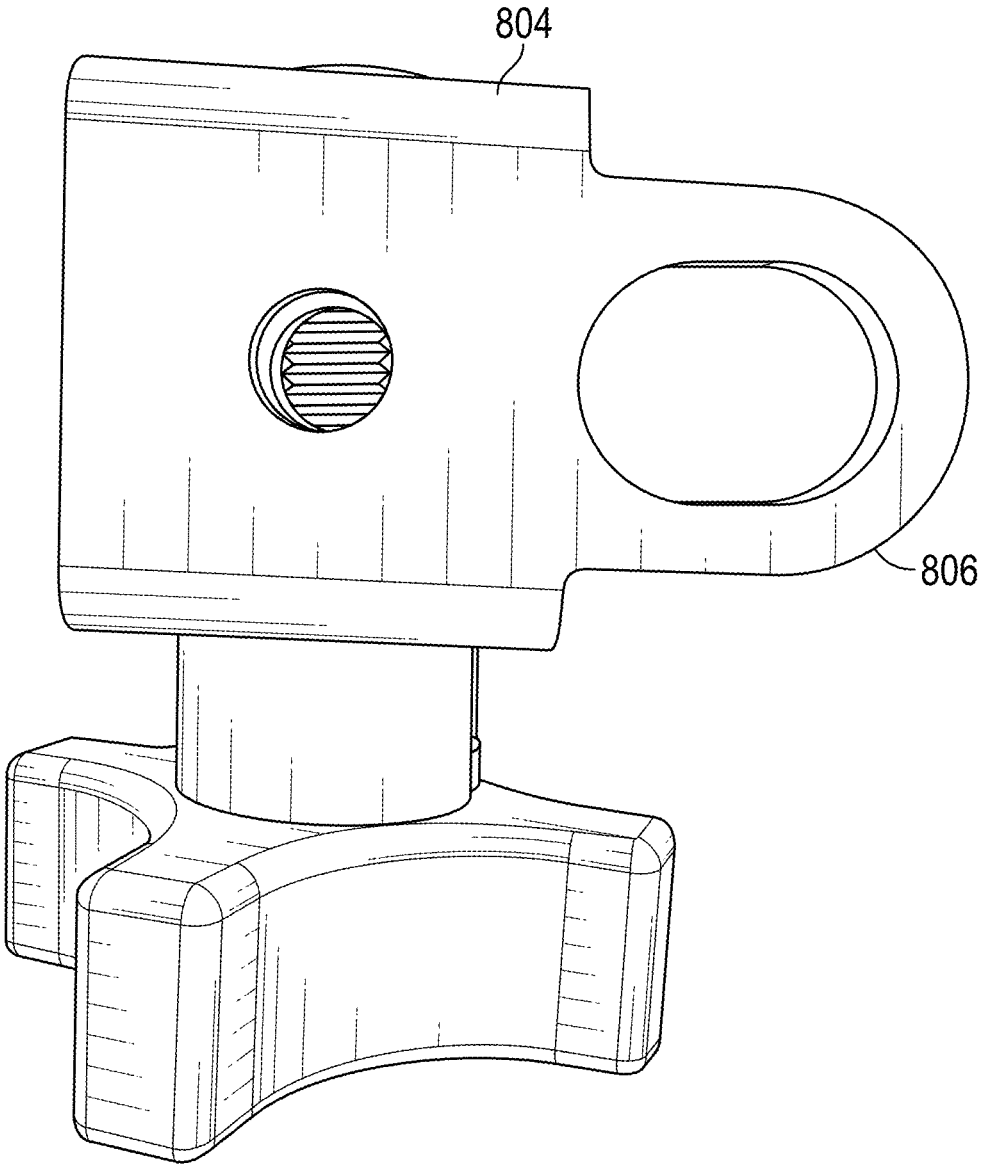
FIG. 12 illustrates a side view of a radial adjustment element, according to an embodiment.

FIG. 12 illustrates an embodiment of the radial adjustment element 804. The radial adjustment element 804 further incorporates the torso strap ring 806 into the structure of the radial adjustment element 804.

Figure 13:
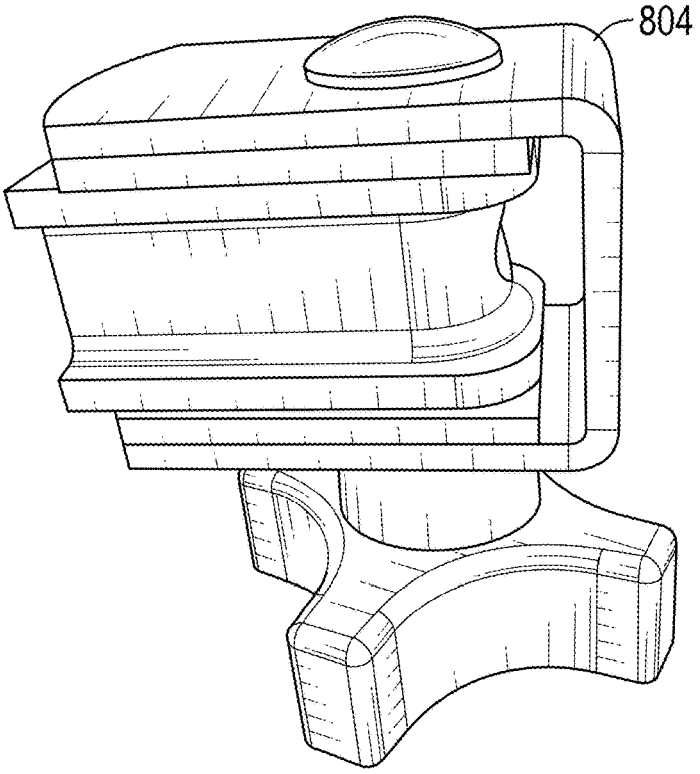
FIG. 13 illustrates a perspective view of the radial adjustment element, according to an embodiment.

FIG. 13 illustrates an embodiment of the radial adjustment element 804, incorporating locking teeth elements 1401. In an embodiment, the knob may be turned to adjust the locking teeth elements 1401 or tighten the locking teeth elements 1401.

Figure 14:
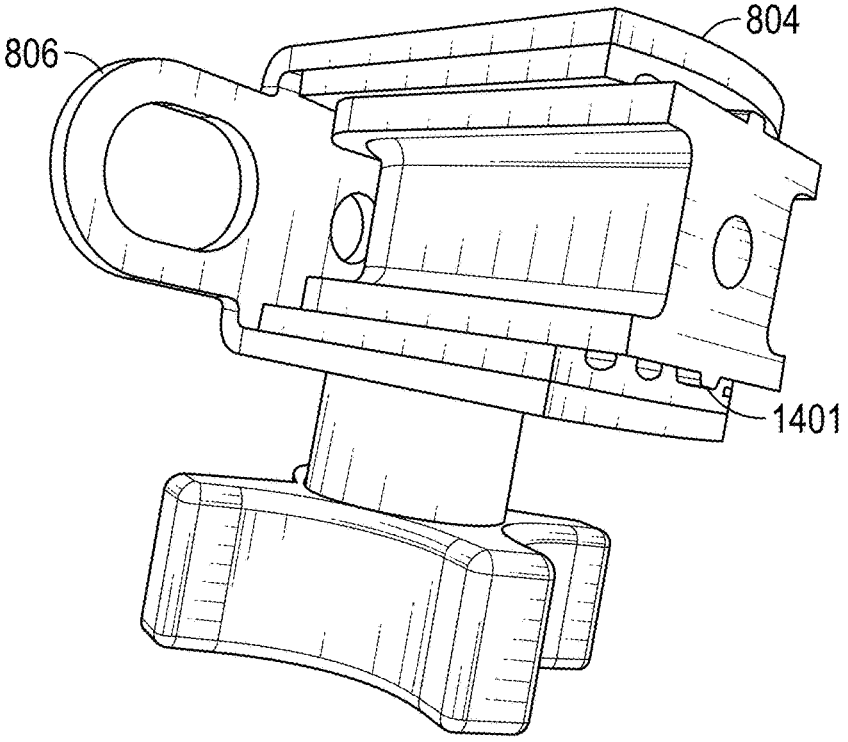
FIG. 14 illustrates a perspective view of the radial adjustment element, according to an embodiment.

FIG. 14 illustrates an embodiment of the radial adjustment element 804, incorporating locking teeth elements 1401, which increase the adjustability and stability of the upper leg 106 by increasing the surface area of contact between the locking teeth elements 1401 and the inside surface of the radial adjustment element 804.

Figure 15:
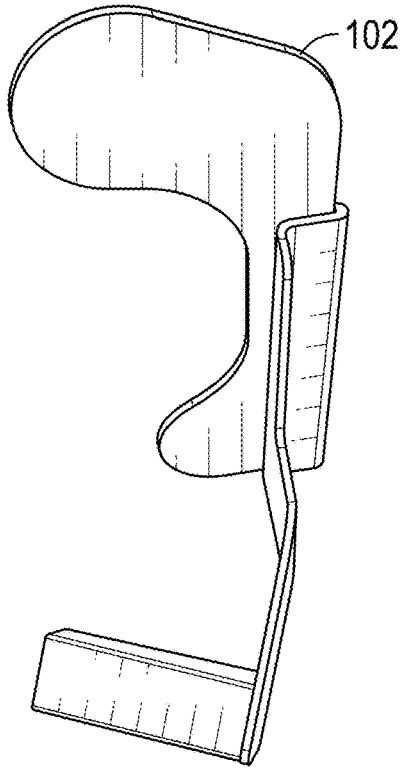
FIG. 15 illustrates a perspective view of a first face support element, according to an embodiment.

FIG. 15 illustrates an embodiment of the face support elements 101 and 102, each of which include a face plate. In an embodiment, each face plate may be equipped with the first and second full face support elements 802 and 803 which may be optimally configured to fit against a user's face, may be more particularly may be positioned and shaped to fit against a user's orbital bones, and which may be angled on the side of the face so visibility for reading, working, gaming is not obscured.

Figure 16:
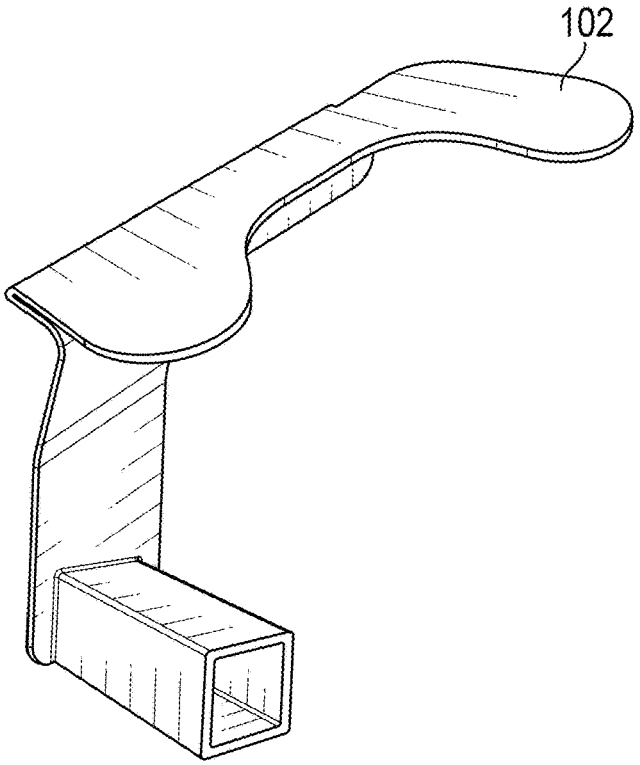
FIG. 16 illustrates a perspective view of a second face support element, according to an embodiment.

FIG. 16 illustrates a front view of the face support element 102. The embodiment may configured to receive a third face support element or a fourth face support element configured to attach to the upper horizontal bar. The third face support element and fourth face support element may comprise an ergonomically designed pad configured to contour to a user's face to support a user's head when the face is placed on the third face support element or fourth face support element.

The present application speaks generally to providing a portable sleep support structure, however, one of ordinary skill in the art will note that the present application may be used for other purposes such as rest, or even to allow a user to utilize a mobile device or laptop when leaning into the sleep support structure, as the user's vision may be unobstructed when using the sleep support structure. The portability of the sleep support structure is owed to its unique shape, the lightweight elements and the ability to detach the elements from each other so that the overall sleep support structure may not occupy much space when it is not assembled.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. An apparatus, comprising:

a T-shaped base member configured to receive a vertically adjustable element comprising a telescoping leg configured to attach to the T-shaped base member via a at least two ball-detent locking mechanisms, wherein:

the vertically adjustable element comprises an upper leg and a lower leg, the upper leg comprising a proximal end with an outer diameter and a distal end attached to an upper horizontal bar, and the lower leg comprising a proximal end and a distal end with an inner diameter and an outer diameter, wherein:

the outer diameter of the upper leg is less than the inner diameter of the lower leg, so that a hollow chamber of the lower leg may receive the proximal end of the upper leg;

the distal end of the lower leg comprises the at least two ball-detent locking mechanisms to secure the upper leg into a position;

the upper leg is rotated about a central axis of the lower leg to engage and disengage the locking mechanism;

a first ring and a second ring configured to receive a torso support strap, wherein:

the T-shaped base member is configured to receive a first horizontal support configured to attach to the T-shaped base member via a locking mechanism; and the T-shaped base member is configured to receive a second horizontal support configured to attach to the T-shaped base member via a locking mechanism;

a first face support element configured to attach to the upper horizontal bar via a first telescoping arm;

a second face support element configured to attach to the upper horizontal bar via a second telescoping arm;

a detachable torso support pad configured to attach to the vertically adjustable element; and a strap attached to the first ring and the second ring on the T-shaped base member, wherein the strap is configured to secure the torso of a user.

2. The apparatus of claim 1, wherein:

the upper leg is fixed such that it does not rotate; and the upper leg is fixed such that it does not engage telescopically when the locking mechanism is engaged.

3. The apparatus of claim 1, wherein the locking mechanism is configured to:

engage when a user rotates the upper leg in a clockwise position; and disengage when the user rotates the upper leg in a counterclockwise position.

4. The apparatus of claim 1, wherein the T-shaped base member further comprises a first detent hole and a second dent hold configurable to receive one or more ball-detent locking mechanisms, to secure the vertically adjustable element, and to adjust a position of the vertically adjustable element.

5. The apparatus of claim 1, wherein the vertically adjustable element is configured to detach from the T-shaped base member such that the apparatus is disassemblable.

6. The apparatus of claim 1, wherein:

the first face support element comprises a first and second ergonomically designed pad configured to contour to a face of the user and to support a head of the user; and the second face support element comprises a third and fourth ergonomically designed pad to contour to the face of the user and to support the head of the user.

7. The apparatus of claim 6, wherein:

the first and second ergonomically designed pads are detachable from the first face support element; and the third and fourth ergonomically designed pads are detachable from the second face support element.

8. The apparatus of claim 7, wherein:

the first face support element is attached to the upper horizontal bar via a first telescoping arm;

the second face support element is attached to the upper horizontal bar via a second telescoping arm, wherein:

the first telescoping arm is configured to extend away from the vertically adjustable member in a first direction perpendicular to the vertically adjustable member; and the second telescoping arm is configured to extend away from the vertically adjustable member in a second direction perpendicular to the vertically adjustable member.

9. The apparatus of claim 1, wherein:

the torso support pad configured to attach to the vertically adjustable element by a V-shaped arm, wherein the V-shaped arm comprises a first telescoping arm and a second telescoping arm; and the V-shaped arm is configured to extend away from the vertically adjustable element in a direction to support the chest of a user.

10. The apparatus of claim 1, wherein the upper horizontal bar is detachable from the upper leg such that the apparatus is disassemblable.

11. An apparatus, comprising a T-shaped base member configured to receive a vertically adjustable element comprising a telescoping leg configured to attach to the T-shaped base member via a plurality of ball-detent locking mechanisms, wherein:

the T-shaped base member comprises:

a pair of rings configured to receive a torso support strap;

a detachable torso support pad attached to the vertically adjustable element; and the T-shaped base member is configured to receive a first horizontal support element, configured to attach to the T-shaped base member via a locking mechanism;

the T-shaped base member is configured to receive a second horizontal support element configured to attach to the T-shaped base member via a locking mechanism;

the telescoping leg comprises:

a locking mechanism to secure the telescoping leg in a position;

a proximal end; and a distal end attached to an upper horizontal bar, wherein the upper horizontal bar comprises:

a first face support element attached to the upper horizontal bar via a first telescoping arm further comprising a first face pad and a second face pad, wherein the first face pad and the second face pad are configured to fit a user's face; and a second face support element attached to the upper horizontal bar via a second telescoping arm, wherein the second face support element comprises:

a first face pad; and a second face pad, wherein the first face pad and the second face pad are configured to fit a user's face.

12. The apparatus of claim 11, wherein:

the first face support element swivels around an axis of the upper horizontal bar to enable a user to comfortably place their head; and the second face support element swivels around an axis of the upper horizontal bar to enable a user to comfortably place their head.

13. The apparatus of claim 11, wherein:

the first face pad and the second face pad of the first face support element are detachable such that the apparatus is disassemblable; and the first face pad and the second face pad of the second face support element are detachable such that the apparatus is disassemblable.

14. The apparatus of claim 11, wherein:

the first face pad of the first face support element is configured to fit a user's cheek bones; and the second face pad of the first face support element is configured to fit the user's orbital bones.

15. The apparatus of claim 14, wherein:

the first face pad of the second face support element is configured to fit the user's cheekbones; and the second face pad of the second support element is configured to fit the user's orbital bones.

16. The apparatus of claim 15, wherein the first and second face pads included on the first and second face support elements respectively are positioned to support the user's head and create an opening to secure the user on the apparatus on the first and second face support elements without obstructing the user's vision.

17. An apparatus, comprising;

a T-shaped base member comprising a pair of rings configured to receive a torso support strap, wherein:

the T-shaped base member is configured to receive a vertically adjustable element comprising:

a telescoping leg, configured to attach to the base member, comprising a proximal end and a distal end attached to an upper horizontal bar;

the distal end of the lower leg comprises one or more ball-detent locking mechanisms to secure the upper leg into a position; and the T-shaped base member further comprises:

a first horizontal support element configured to attach to the T-shaped base member, a second horizontal support element configured to attach to the T-shaped base member;

a first face support element configured to attach to the upper horizontal bar, wherein the first face support element is attached to the upper horizontal bar via a first telescoping arm;

a second face support element configured to attach to the upper horizontal bar, wherein the second face support element is attached to the upper horizontal bar via a second telescoping arm; and a torso support pad attached to the vertically adjustable element.

18. An apparatus of claim 17 wherein:

the apparatus further comprises a torso support system;

the torso support system comprises a frame attached to a V-shaped arm, wherein:

the V-shaped arm is connected to a clamp configured to detachably release and attach to the telescoping leg; and the frame further comprises the torso support pad to support a user's chest.

19. An apparatus of claim 18, wherein:

a strap is attached to the pair of rings on the T-shaped base member; and the strap is configured to secure the torso of a user.

20. An apparatus of claim 19, wherein:

the torso support pad is detachable such that the apparatus is disassemblable; and the torso support pad is ergonomically designed to fit against the chest of a user.

* * * * *